US008826653B2

(12) United States Patent
Komiyama et al.

(10) Patent No.: US 8,826,653 B2
(45) Date of Patent: Sep. 9, 2014

(54) SLEWING TYPE WORKING MACHINE

(75) Inventors: Masayuki Komiyama, Hiroshima (JP); Yusuke Kamimura, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 14/007,884

(22) PCT Filed: Apr. 19, 2012

(86) PCT No.: PCT/JP2012/002722

§ 371 (c)(1),
(2), (4) Date: Sep. 26, 2013

(87) PCT Pub. No.: WO2012/150651

PCT Pub. Date: Nov. 8, 2012

(65) Prior Publication Data

US 2014/0013752 A1 Jan. 16, 2014

(30) Foreign Application Priority Data

May 2, 2011 (JP) ..... 2011-103058
May 11, 2011 (JP) ..... 2011-106184

(51) Int. Cl.

| | |
|---|---|
| ***E02F 9/12*** | (2006.01) |
| ***E02F 9/20*** | (2006.01) |
| ***F15B 11/08*** | (2006.01) |
| ***E02F 9/26*** | (2006.01) |
| ***F15B 7/00*** | (2006.01) |
| ***E02F 9/22*** | (2006.01) |

(52) U.S. Cl.

CPC ..... *E02F 9/123* (2013.01); *E02F 9/2091* (2013.01); *E02F 9/128* (2013.01); *F15B 11/08* (2013.01); *E02F 9/268* (2013.01); *F15B 7/006* (2013.01); *E02F 9/2095* (2013.01); *E02F 9/2217* (2013.01)

USPC ..... 60/403; 60/414; 60/466; 60/468

(58) Field of Classification Search

CPC ..... E02F 9/12; E02F 9/123

USPC ..... 60/414, 466, 468, 403; 414/744.2

See application file for complete search history.

(56) References Cited

U.S. PATENT DOCUMENTS 6,732,513 B2 * 5/2004 Tajima ..... 60/468
6,761,029 B2 7/2004 Linerode (Continued)

FOREIGN PATENT DOCUMENTS

JP 8 200305 8/1996
JP 2005 344431 12/2005

(Continued)

OTHER PUBLICATIONS

International Search Report Issued Jul. 31, 2012 in PCT/JP12/002722 Filed Apr. 19, 2012.

(Continued)

*Primary Examiner* — F. Daniel Lopez

(74) *Attorney, Agent, or Firm* — Oblon, Spivak, McClelland, Maier & Neustadt, L.L.P.

(57) ABSTRACT

A slewing-type working machine includes: a hydraulic motor for slewing an upper slewing body; a hydraulic pump; a slewing operation device including an operation member; a control valve controlling the hydraulic motor based on an operation signal of the slewing operation device; first and second pipe-lines connecting first and second ports of the hydraulic motor to the control valve; communication switching devices switching communication and cutoff between both pipe-lines and a tank; an electric motor; an electric storage device; and a controller, which communicates an outlet-side pipe-line to the tank during slewing, makes a brake based on a regenerative action by the electric motor and the electric storage device and causes the electric storage device to store regenerative power, upon deceleration operation. Upon failure occurrence, the controller brings the communication switching devices to a communication-cutoff state and stops the regenerative action to secure slewing.

4 Claims, 3 Drawing Sheets

(56) References Cited

U.S. PATENT DOCUMENTS

| | | | | |
|---|---|---|---|---|
| 7,066,446 | B2 | 6/2006 | Nielsen | |
| 2010/0263364 | A1 | 10/2010 | Tsutsui et al. | |
| 2013/0213026 | A1 * | 8/2013 | Yamamoto et al. | 60/327 |

FOREIGN PATENT DOCUMENTS

| | | | |
|---|---|---|---|
| JP | 2008-063888 | | 3/2008 |
| JP | 2012 65510 | | 3/2010 |
| JP | 202065510 | * | 3/2010 |
| JP | 2012 127123 | | 7/2012 |
| WO | 2012/035735 | | 3/2012 |

OTHER PUBLICATIONS

Japanese Office Action Issued Jul. 24, 2012 in JP Patent Application No. 2001-103058 Filed May 2, 2011 (with English translation).

* cited by examiner

SLEWING TYPE WORKING MACHINE

TECHNICAL FIELD

The present invention relates to a slewing-type working machine such as an excavator.

BACKGROUND ART

The background art of the present invention will be described using an excavator as an example.

For example, as shown in FIG. 3, a general excavator comprises a crawler-type base carrier 1, an upper slewing body 2 mounted on the base carrier 1 so as to be capable of being slewed around an axis X perpendicular to the ground, and an excavating attachment 3 attached to the upper slewing body 2. The excavating attachment 3 includes a boom 4 capable of being raised and lowered, an arm 5 attached to a tip of the boom 4, a bucket 6 attached to a tip of the arm 5, and respective cylinders (hydraulic cylinders) for actuating the boom 4, the arm 5, and the bucket 6: namely, a boom cylinder 7, an arm cylinder 8, and a bucket cylinder 9.

Japanese Patent Application Laid-open No. 2010-65510 (Patent Document 1) discloses an excavator, such as that described above, further including a hydraulic motor for slewing an upper slewing body, an electric motor connected to the hydraulic motor, and an electric storage device, wherein the electric motor performs a regenerative action, when the slewing is decelerated, to exert a braking force and store the regenerative power in the electric storage device.

This technique, however, can lose a normal regenerative action (a braking action and a power recovery action) in the case of an occurrence of a failure in the electric motor, the electric storage device, or an electric system including a control system that controls them: for example, in the case of a failure of the electric motor which failure prevents a brake torque from being generated or in the case of the state where the electric storage device becomes incapable of recovering regenerative power. The occurrence of such a failure during slewing makes the slewing unable to be stopped and can involve damage of the electric motor or the electric storage device. Thereafter, the slewing is impossible until repairs are made, thus making work impossible.

Patent Document 1: Japanese Patent Application Laid-open No. 2010-65510

SUMMARY OF THE INVENTION

An object of the present invention is to provide a slewing-type working machine including an electric motor and an electric storage device for regeneration during slewing and being capable of protecting the electric motor and the electric storage device upon occurrence of a failure of an electric system including the electric motor and the electric storage device, while maintaining the slewing. The slewing-type working machine provided by the present invention includes: a base carrier; an upper slewing body mounted on the base carrier so as to be capable of being clewed; a hydraulic motor including first and second ports to receive supply of hydraulic fluid through one of the ports and discharging the hydraulic fluid through the other one of the ports, thereby being operated so as to drive the upper slewing body to slew it; a hydraulic pump which discharges the hydraulic fluid to be supplied to the hydraulic motor; an electric motor rotationally driven by the hydraulic motor to perform a regenerative action; an electric storage device which stores regenerative power of the electric motor; a slewing operation device which includes an operation member to which an operation is applied to input a command for driving to slew and outputs an operation signal corresponding to the operation applied to the operation member; a control valve which is operated so as to control supply of hydraulic fluid to the hydraulic motor and discharge of hydraulic fluid from the hydraulic motor, based on the operation signal of the slewing operation device; a first pipe-line connecting the first port of the hydraulic motor to the control valve; a second pipe-line connecting the second port of the hydraulic motor to the control valve; a brake valve connected to the first and second pipe-lines to perform a hydraulic braking action against the hydraulic motor when the operation in a direction for deceleration is applied to the operation member; a communication switching device capable of being switched between a communication state of bringing a pipe-line on an outlet side of the hydraulic motor of both of the pipe-lines into communication with a tank or a pipe-line on an inlet side of the hydraulic motor of both of the pipe-lines and a communication-cutoff state of cutting off the communication; an operation detector which detects the operation applied to the operation member of the slewing operation device; and a controller which controls switching of the communication switching device based on a detection signal from the operation detector. The controller judges whether or not there has been occurrence of an abnormal situation where a regenerative action by the electric motor and the electric storage device is impossible or inappropriate, based on signals from an electric system including the electric motor, the electric storage device, and respective control systems of the electric motor and the electric storage device. At least in the case where the deceleration operation is being performed, when the controller judges that the abnormal situation has not occurred, the controller switches the communication switching device to the communication state and outputs a drive command for causing the electric motor to perform a regenerative action. In the case of judging that the electric system is in the abnormal situation, the controller switches the communication switching device to the communication-cutoff state and outputs a non-drive command for prohibiting the electric motor from performing a regenerative action.

EMBODIMENT FOR CARRYING OUT THE INVENTION

Figure 3:
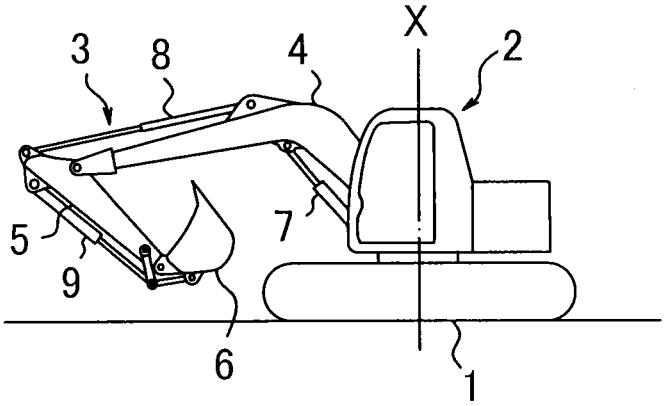
FIG. 3 is a side view showing a general excavator.

There will be explained an embodiment of the present invention. This embodiment has an application object similar to that of the background art, that is, the excavator shown in FIG. 3.

Figure 1:
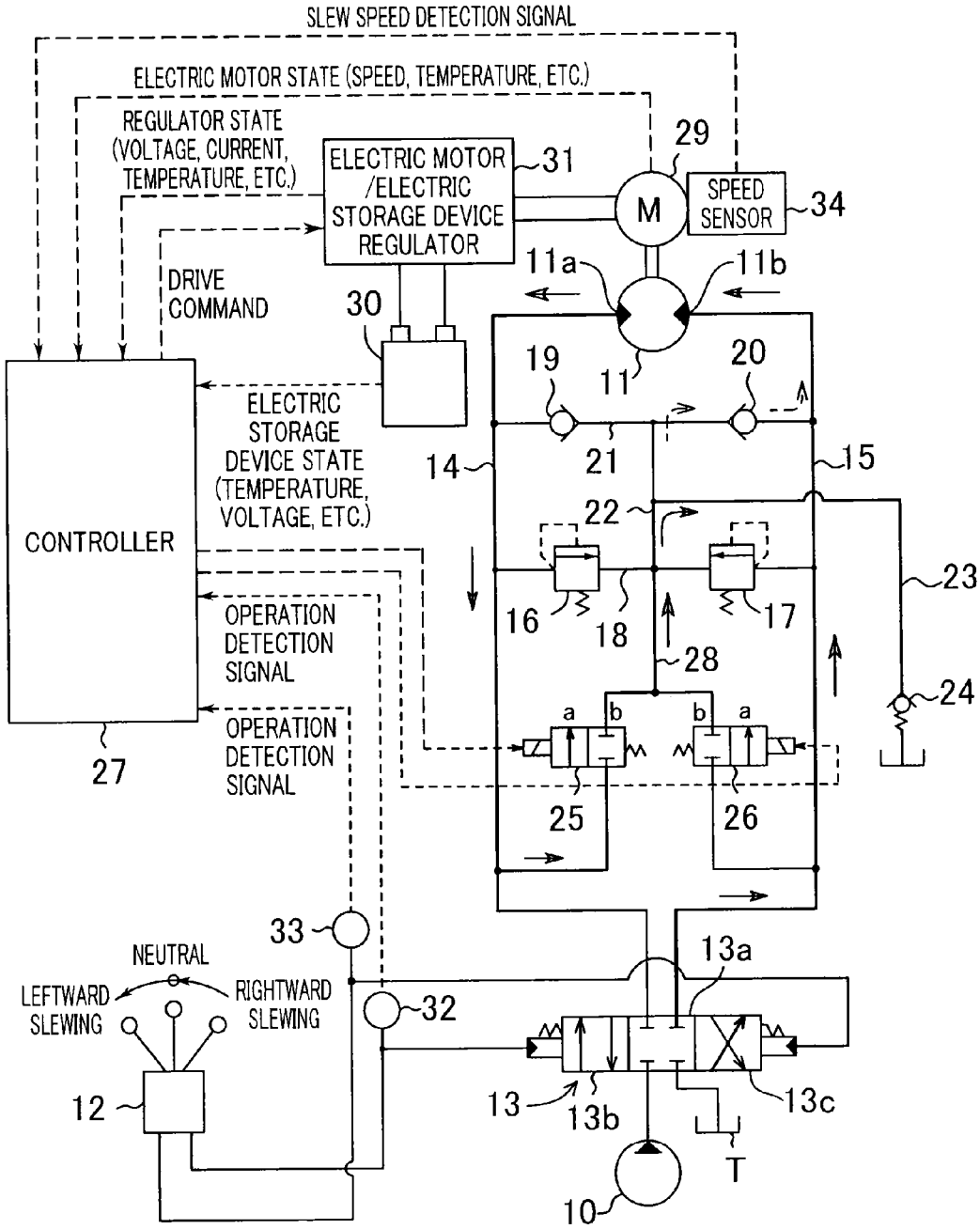
FIG. 1 is a diagram showing a hydraulic circuit according to an embodiment of the present invention.

FIG. 1 shows a hydraulic circuit according to the embodiment of the present invention. The circuit includes: a hydraulic pump 10 as a hydraulic pressure source, which is driven by an engine not graphically shown; a slewing hydraulic motor 11 which is rotated by supply of hydraulic fluid discharged from the hydraulic pump 10 to drive the upper slewing body 2 to slew it, a remote-control valve 12 as a slewing operation device including a lever 12*a* to which an operation is applied to input a command for driving to slew; and a control valve 13 which is a pilot controlled selector valve that can be operated by the remote-control valve 12 and is provided between the hydraulic motor 11 and a pair of the hydraulic pump 10 and a tank T.

The hydraulic motor 11 includes a left port 11*a* and a right port 11*b* which are first and second ports, respectively. When supplied with hydraulic fluid through the left port 11*a*, the hydraulic motor 11 discharges the hydraulic fluid through the right port 11*b* and leftward slews the upper slewing body 2 shown in FIG. 7. Conversely, when supplied with hydraulic fluid through the right port 11*b*, the hydraulic motor 11 discharges the hydraulic fluid through the left port 11*a* and rightward slews the upper slewing body 2.

The lever 12*a* of the remote-control valve 12 is operated between a neutral position and right and left slewing positions, and the remote-control valve 12 outputs pilot pressure with a magnitude corresponding to an operation amount of the lever 12*a* from a port corresponding to an operation direction of the lever 12*a*. The control valve 13 is switched from a graphically shown neutral position 13*a* to a left slewing position 13*b* or a right slewing position 13*c* by the pilot pressure, thereby controlling respective directions of supply of the hydraulic fluid to the hydraulic motor 11 and of right and left discharge direction of the hydraulic fluid from the hydraulic motor 11, and a flow rate of the hydraulic fluid. In other words, performed are: switching slewing state, that is, selectively switching to respective states of acceleration (including start-up), steady operation at a constant speed, deceleration, and stop; and controlling the slewing direction and the slew speed.

The circuit includes: a left slewing pipe-line 14 and a right slewing pipe-line 15 which are the first and second pipe-lines, respectively; a relief valve circuit 18; a check valve circuit 21, a communication path 22, and a make-up line 23.

The left slewing pipe-line 14 connects the control valve 13 to the left port 11*a* of the hydraulic motor 11, and the right slewing pipe-line 15 connects the control valve 13 to the right port 11*b* of the hydraulic motor 11. The relief valve circuit 18, the check valve circuit 21, and the communication path 22 are provided between both slewing pipe-lines 14 and 15.

The relief valve circuit 18 is provided so as to interconnect the slewing pipe-lines 14 and 15. The relief valve circuit 18 includes a pair of relief valves 16 and 17 having respective outlets which are opposed and connected to each other.

The check valve circuit 21 is arranged parallel to the relief valve circuit 18 at a position closer to the hydraulic motor 11 than the relief valve circuit 18 so as to interconnect the slewing pipe-lines 14 and 15. The check valve circuit 21 includes a pair of check valves 19 and 20 having respective inlets which are opposed and connected to each other.

The communication path 22 connects a first portion of the relief valve circuit 18, the first portion located between the relief valves 16 and 17, to a second portion of the check valve circuit 21, the second portion located between the check valves 19 and 20. The make-up line 23 connects the communication path 22 to the tank T in order to suck up hydraulic fluid. The make-up line 23 is provided with a back pressure valve 24.

In this apparatus, when the remote-control valve 12 is not operated, that is, when the lever 12*a* thereof is at a neutral position, the control valve 13 is kept at the neutral position 13*a* shown in FIG. 1. Upon operation applied to the lever 12*a* from this state, the control valve 13 moves from the neutral position 13*a* to a left-side position in the diagram (a leftward slewing position) 13*b* or a right-side position in the diagram (a rightward slewing position) 13*c* by a stroke corresponding to an amount of the applied operation.

At the neutral position 13*a*, the control valve 13 blocks both of the slewing pipe-lines 14 and 15 from the pump 10 to prevent the hydraulic motor 11 from rotation. Upon operation applied to the lever 12*a* of the remote-control valve 12 on a leftward or rightward slewing side, from the state, the control valve 13 is switched to the leftward slewing position 13*b* or the rightward slewing position 13*c* to permit supply of pressure fluid to the left slewing pipe-line 14 or the right slewing pipe-line 15 from the hydraulic pump 10. The hydraulic motor 11 is thereby rotated to the left or right to come into a state of driving to slew the upper slewing body 2, that is, an accelerating state or a steady operation state. In this state, the fluid discharged from the hydraulic motor 11 is returned to the tank T via the control valve 13.

For example, upon a deceleration operation applied to the remote-control valve 12 during rightward slewing, that is, upon returning the lever 12*a* thereof to the neutral position or upon operation in a direction toward the neutral position, supply of pressure fluid to the hydraulic motor 11 and return of fluid from the hydraulic motor 11 to the tank T are stopped or a flow rate of the supplied hydraulic fluid and a flow rate of the return fluid are reduced. Meanwhile, the hydraulic motor 11 continues rightward rotation due to inertia of the upper slewing body 2, which raises pressure in the left slewing pipe-line 14 on a meter-out-side of the hydraulic motor 11. When the pressure reaches a certain value, the relief valve 16 on the left side in the diagram is opened to allow the fluid in the left slewing pipe-line 14 to sequentially pass through the relief valve 16, the communicating path 22, the check valve 20 on the right side in the diagram, and the right slewing pipe-line (a meter-in side pipe-line) 15 to flow into the hydraulic motor 11, as indicated by a dashed line arrow in FIG. 1. The hydraulic motor 11 thereby receives a hydraulic braking force due to the relief action, while making inertial rotation, to be decelerated and stopped. Deceleration/stop from a leftward slewing is also made in the same manner. Besides, when the slewing pipe-line 14 or 15 tends to negative pressure during the deceleration, tank fluid is sucked up through the slewing pipe-line 14 or 15 along a route in order of the makeup line 23, the communicating path 22, and the check valve circuit 21, thus preventing cavitation.

The circuit according to the embodiment further comprises: a left communication valve 25 and a right communication valve 26 which are respective first communication valve and the second communication valve, constituting the communication switching device; a controller 27; a slewing electric motor 29 capable of being rotationally driven by the hydraulic motor 11; an electric storage device 30; an electric-motor-and-electric-storage-device controller 31 which controls the slewing electric motor 29 and the electric storage device 30 on the basis of a command from the controller 27; pressure sensors 32 and 33 which are operation detectors; and a speed sensor 34 which is a speed detector.

Each of the communication valves 25 and 26 comprises a solenoid switching valve, adapted to be switched between an open position "a" and a closed position "b" by command signals inputted from the controller 27. The communication valves 25 and 26 include respective inlet-side ports connected to the slewing pipe-lines 14 and 15 and respective outlet-side ports connected through a passage 28 to a part of the relief valve circuit 18, the part being between both relief valves 16 and 17. Since the portion of the relief valve circuit 18 is connected to the tank T through the communicating path 22 and the makeup line 23 as described earlier, the communication valves 25 and 26 set to the open position "a" bring the slewing pipe-lines 14 and 15 into direct communication with the tank T, respectively, while bypassing the control valve 13.

The pressure sensors 32 and 33 detect respective operations applied to the remote-control valve 12 through pilot pressure outputted from the remote-control valve 12, that is, detect whether the lever 12*a* is at the neutral position or an operation for a leftward slewing or a rightward slewing has been applied to the lever 12. Specifically, the pressure sensors 32 and 33 output respective operation detection signals corresponding to respective pilot pressures outputted from the remote-control valve 12. The speed sensor 34 detects a rotational speed of the slewing electric motor 29, that is, a speed corresponding to a slew speed of the upper slewing body 2, and outputs a slew speed detection signal.

The controller 27 judges whether the upper slewing body 2 is being driven to be slewed (in acceleration including start-up or in steady operation), or decelerated, or in a stopped state, based on an operation detection signal inputted from the pressure sensors 32 and 33 and on a slew speed detection signal inputted from the speed sensor 34. When judging that the upper slewing body 2 is being driven to be slewed, the controller 27 switches only one of the communication valves 25 and 26 to the open position "a", wherein the communication valve to be changed is opposite one to the operated communication valve of both, in other words, the communication valve connected to a pipe-line corresponding to an outlet-side pipe-line into which hydraulic fluid is discharged from the hydraulic motor 11, of both of the slewing pipe-lines 14 and 15 (during rightward slewing, the communication valve to be switched is the left communication valve 25 connected to the left slewing pipe-line 14, while, during a leftward slewing, the communication valve to be switched is the right communication valve 26 connected to the right slewing pipe-line 15: hereinafter referred to as an "outlet-side communication valve").

The hydraulic fluid discharged from the hydraulic motor 11 to the left slewing pipe-line 14 or the right slewing pipe-line 15 during slewing is, therefore, directly returned to the tank T through the communication valve 25 or 26 that is connected to the outlet-side pipe path, while bypassing the control valve 13. For example, during rightward slewing, hydraulic fluid discharged from the hydraulic motor 11 is returning to the tank T through the left slewing pipe-line 14, the left communication valve 25, the passage 28, the communicating path 22, and the makeup line 23, as indicated by bold line and solid line arrows in FIG. 1. During the slewing, the slewing electric motor 29 is rotated so as to be involved by the hydraulic motor 11. In other words, the slewing electric motor 29 is driven by the hydraulic motor 11.

For example, when the lever 12*a* of the remote-control valve 12 is operated from the rightward slewing state in a deceleration direction, in other words, operated so as to be returned to the neutral position or operated in a direction toward the neutral position, the hydraulic fluid is circulated so as to return to the right slewing pipe-line 15 passing through the communicating path 22 and the right check valve 20 of the check valve circuit 21, as indicated by the dashed-line arrow in FIG. 1. In this time, the slewing electric motor 29 performs a generator (regenerative) action, based on a regeneration command from the controller 27, thus exerting a braking force against the rotation of the hydraulic motor 11 and supplying the generated regenerative power to the electric storage device 30 to make the electric storage device 30 store it. This regenerative action causes the rotation of the hydraulic motor 11 to be braked, thus decelerating/stopping the upper slewing body 2.

On the other hand, in a slewing stopped state, the communication valves 25 and 26 are closed by a command signal from the controller 27, while the hydraulic motor 11 and the upper slewing body 2 are kept stopped by a hydraulic brake produced by the relief valve circuit 18.

To the controller 27, there are constantly inputted respective information for the judgment of the presence/absence of a failure of the electric system: from the electric motor 29, the information related to a state (speed, temperature, and the like) of the electric motor 29 is inputted; from the electric storage device 30, the information related to a state (temperature, voltage, and the like) of the electric storage device 30 is inputted; and from the electric motor/electric storage device regulator 31, the information related to a state (voltage, current, temperature, and the like) of the electric motor/electric storage device regulator 31 are inputted. The controller 27 includes a failure judgment section which judges the presence/absence of a failure based on the information, and a command section which inputs a drive command for the electric motor 29 to the electric motor/electric storage device regulator 31 in a normal operation state as described earlier and inputs a non-drive command (regeneration stop command) to the electric motor 29 in the event of a failure.

Figure 2:
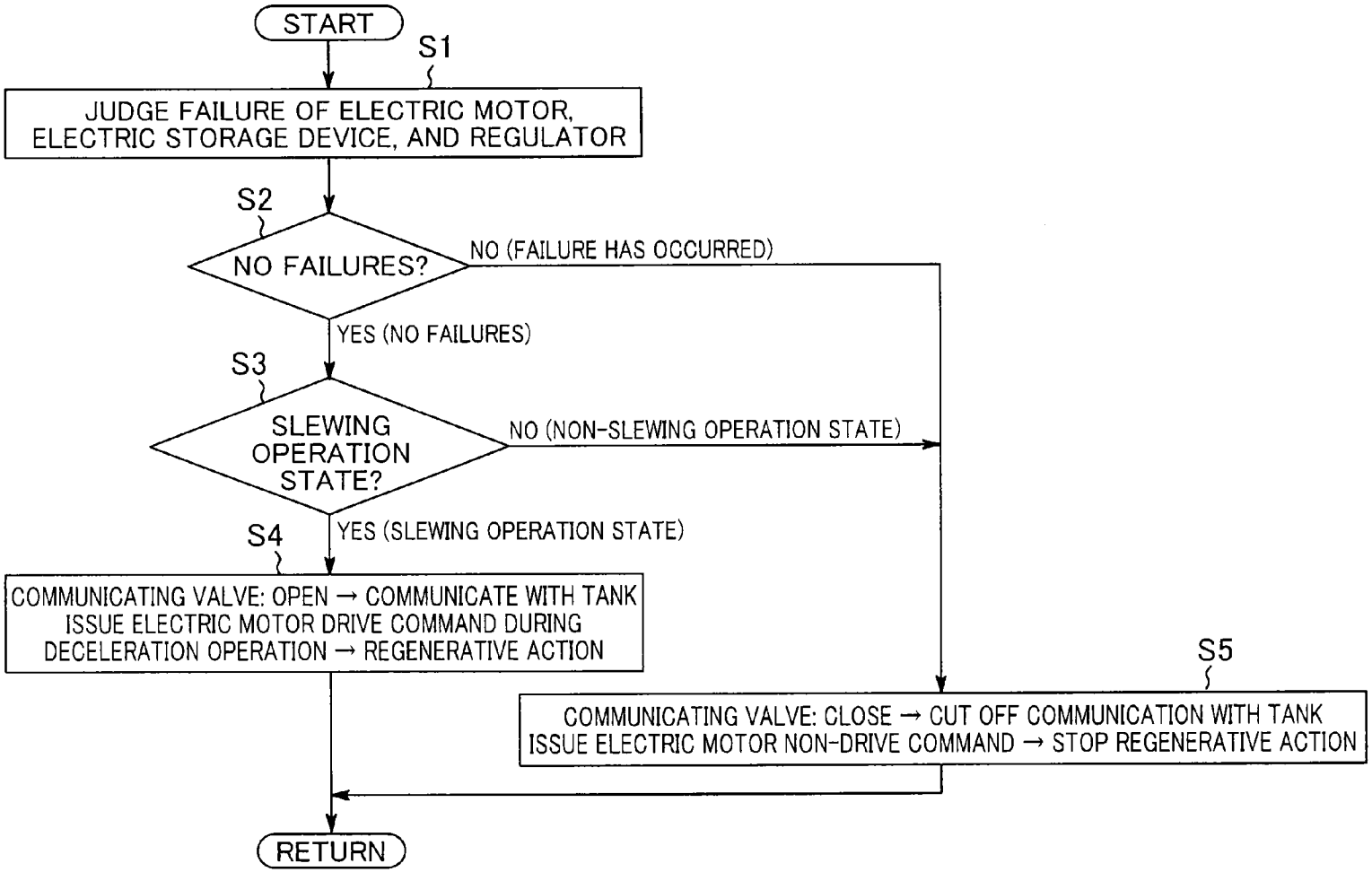
FIG. 2 is a flow chart showing a control operation of a controller according to the embodiment.

There will be described a specific control operation performed by the controller 27, with reference to the flow chart shown in FIG. 2.

Upon start of control, in steps S1 and S2, based on state signals from the electric motor 29, the electric storage device 30 and the regulator 31, the controller 27 performs a failure judgment on the entire electric system including the electric motor 29, the electric storage device 30 and the regulator 31 as well as wiring. In the case of YES, i.e., in the case of totally no failures, the controller 29 makes judgment in step S3, based on the presence/absence of an operation and the slewing speed, on whether the present state is a slewing operation state or not, in other words, whether the present state is a slewing-driving state or a slewing-deceleration state; wherein, the slewing-driving state includes both of a slewing accelerating state and a steady operation state, and the slewing-deceleration state refers to both of a deceleration state due to applying a return operation to the lever 12*a* of the remote-control valve 12 from the leftward slewing position or the rightward slewing position toward the neutral position and a deceleration state due to returning the lever 12*a* to the neutral position.

In the case of YES in step S3, that is, in the case of judging that the present state is a slewing state, in step S4, the controller 27 inputs a command signal into an outlet-side communication valve that is one on an opposite side to an operated one of the communication valves 25 and 26, for example, the left communication valve 25 during a rightward slewing, to thereby open the outlet-side communication valve. The thus opened communication valve, namely, the outlet-side communication valve, allows the hydraulic fluid discharged from the hydraulic motor 11 to be directly returned to the tank while bypassing the control valve 13, thereby permitting back pressure due to a throttle action of the control valve to be eliminated. This makes it possible to reduce the back pressure acting on the meter-out-side of the hydraulic motor 11 during slewing to thereby lower the meter-in-side pressure and pump pressure, thus allowing power loss of the hydraulic pump 10 to be suppressed to eliminate energy wasting.

Besides, the controller 27, storing a map set in advance based on an operation amount of the remote-control valve 12 and target speed, determines a target speed based on the map and on an actual operation amount of the remote-control valve 12, and judges whether the hydraulic motor 11 is driving to slew or decelerating based on the comparison of the target speed with an actual rotational speed. In the case of judging that the hydraulic motor 11 is driving to slew, the controller 27 inputs a valve-opening command to the outlet-side communication valve of the communication valves 25 and 26 as described above, while, in the case of judging that the hydraulic motor 11 is decelerated, the controller 29 inputs a drive command for the electric motor 29 into the electric motor/electric storage device regulator 31, in addition to the open valve command. The electric motor 29, having received the drive command, performs a regenerative braking action to apply braking to the hydraulic motor 11 and makes the electric storage device 30 store the regenerative power.

Thus, if the electric system being in a normal state, there is performed a regenerative action by the electric motor 29 and the electric storage device 30 during deceleration.

In contrast, in the case of judging NO in step S2, that is, in the case of judging that a failure has occurred at a specific element included in the electric system, or in the case of judging that the present state is not a slewing state, that is, the present state is a slewing stopped state, in step S3, the controller 27 performs step S5. Herein, "failure" includes: heating, overspeed, overload, and the like with respect to the electric motor 29; high temperature, cell imbalance, overvoltage, set voltage abnormality, and the like with respect to the electric storage device 30; and sensor failure, overcurrent, CPU failure, input overvoltage, input undervoltage, overheating, and the like with respect to the regulator 31. In step S5, the controller 27 causes the communication valves 25 and 26 to be closed and outputs a non-drive command, i.e., a command for stopping the regenerative action to the electric motor 29, thereby stopping the regenerative action by the electric motor 29 and the electric storage device 30 and causing the relief valve circuit 18*a* to perform a hydraulic braking action.

As described above, this work machine is capable of reducing back pressure generated during slew driving to lower the pump pressure when the electric system is normal and further capable of making the electric motor 29 and the electric storage device 30 perform a regenerative action during decelerating to regenerate slewing energy to thereby improve energy efficiency. On the other hand, when a failure occurs in the electric system, the communication made by the communication valves 25 and 26 is cut off and the regenerative action is stopped to thereby produce a state similar to an ordinary hydraulic excavator with neither of the electric motor 29, the electric storage device 30, and the communication valves 25 and 26, and, in this state, hydraulic braking by a brake valve is exerted during deceleration; this enables a slewing motion to be secured and allows the work to be continued. Besides, stopping the regenerative action makes it possible to avoid the occurrence of over-current and over-voltage in the electric motor 29 and the electric storage device 30 to protect them therefrom.

The present invention is not limited to the above-described embodiment but includes modes as follows.

(1) While the communication switching device according to the embodiment includes respective communication valves 25 and 26 provided between pipe-lines 14 and 15 on both sides of the motor and the tank T, wherein each of the communication valves is switched between an open position "a" for bringing the motor outlet-side pipe-line into communication with the tank T and a closed position "b" for cutting off the communication, the communication switching device may include respective communication valves which are switched between a position for directly connecting the pipe-lines on both sides of the motor and a position for connecting the pipe-lines on both sides of the motor to the control valve similar to the direct-connection switching valve described in Patent Document 1, wherein the communication valves are provided between the pipe-lines on respective sides of the motor and the control valve. In this mode, the communication valves only have to be switched to the open position to exert regenerative braking only during slew deceleration, which allows an effect basically similar to that of the above embodiment to be obtained.

(2) In the above embodiment, the slewing state (for example, stop of the slewing) is judged by use of an electric motor speed signal from the speed sensor 29; however, the slewing state can also be judged by other means with no use of an electric motor speed signal. For example, the stop of the slewing can be determined by the condition where the operation member of the slewing operation device (the lever 12*a* of the remote-control valve 12) continues to be at the neutral position for a certain period of time.

(3) While the communication valves 25 and 26 according to the embodiment are set to a communication-cutoff position even in a slewing stopped state, the present invention also permits a stop state to be kept by position retention control of the electric motor, a mechanical brake, or the like, under the condition where the communication switching device is set to an opened state in the slewing stopped state.

(4) The slewing-type working machine according to the present invention is not limited to an excavator. For example, the present invention may also be applied to other slewing-type working machines such as a demolition machine or a crusher which is formed by utilization of a mother body of an excavator.

As described above, according to the present invention, provided is a slewing-type working machine including an electric motor and an electric storage device for regeneration during slewing and being capable of protecting the electric motor and the electric storage device upon occurrence of a failure in an electric system including the electric motor and the electric storage device while maintaining the slewing operation. The slewing-type working machine comprises: a base carrier; an upper slewing body mounted on the base carrier so as to be capable of being slewed; a hydraulic motor including first and second ports to receive supply of hydraulic fluid through one of the ports and discharging the hydraulic fluid through the other one of the ports, thereby being operated so as to drive the upper slewing body to slew it; a hydraulic pump which discharges the hydraulic fluid to be supplied to the hydraulic motor; an electric motor rotationally driven by the hydraulic motor to perform a regenerative action; an electric storage device which stores regenerative power of the electric motor; a slewing operation device which includes an operation member to which an operation is applied to input a command for driving to slew and outputs an operation signal corresponding to the operation applied to the operation member; a control valve which is operated so as to control supply of hydraulic fluid to the hydraulic motor and discharge of hydraulic fluid from the hydraulic motor, based on the operation signal of the slewing operation device; a first pipe-line connecting the first port of the hydraulic motor to the control valve; a second pipe-line connecting the second port of the hydraulic motor to the control valve; a brake valve connected to the first and second pipe-lines to perform a hydraulic braking action against the hydraulic motor when the operation in a direction for deceleration is applied to the operation member; a communication switching device capable of being switched between a communication state of bringing a pipe-line on an outlet side of the hydraulic motor of both of the pipe-lines into communication with a tank or a pipe-line on an inlet side of the hydraulic motor of both of the pipe-lines and a communication-cutoff state of cutting off the communication; an operation detector which detects an operation applied to the operation member of the slewing operation device; and a controller which controls switching of the communication switching device based on a detection signal from the operation detector. The controller judges whether or not there has been occurrence of an abnormal situation where a regenerative action by the electric motor and the electric storage device is impossible or inappropriate, based on signals from an electric system including the electric motor, the electric storage device, and respective control systems of the electric motor and the electric storage device. At least in the case where the deceleration operation is being performed, when the controller judges that the abnormal situation has not occurred, the controller switches the communication switching device to the communication state and outputs a drive command for causing the electric motor to perform a regenerative action. In the case of judging that the electric system is in the abnormal situation, the controller switches the communication switching device to the communication-cutoff state and outputs a non-drive command for prohibiting the electric motor from performing a regenerative action.

According to this work machine, when the electric system is in a normal state, the communication valve is opened at least during slewing deceleration to bring the pipe-line on the outlet-side of the hydraulic motor into communication with the tank or the inlet-side pipe-line, thereby enabling the electric motor to produce a regenerative action to exert a braking force while recovering slewing energy during deceleration in a normal state of the electric system. On the other hand, when a failure occurs in the electric system including the electric motor and the electric storage device, the communication valve is closed to cut off the communication and the regenerative action of the electric motor is stopped, which allows the brake valve to exert a hydraulic braking action during deceleration similarly to a normal hydraulic excavator. This makes it possible to protect the electric storage device and the electric motor by stopping the regenerative action while securing a slewing operation to allow work to be continued.

For example, the communication switching device is preferably provided between the first and second pipe-lines and the tank and switchable among a state of cutting of both of the pipe-lines from the tank, a state of brining the first pipe-line into communication with the tank and cutting off the second pipe-line from the tank, and a state of bringing the second pipe-line into communication with the tank and cutting off the first pipe-line from the tank. In this case, it is favorable that the controller operates the communication switching device, when the electric system is in a normal state and a slewing operation is being performed, so as to bring a pipe-line corresponding to an outlet-side pipe-line, which is one pipe-line on an outlet side of the hydraulic motor of the first and second pipe-lines, into communicated with a tank and so as to cut off the other one of the pipe-lines from the tank. The communication also produces an effect of reducing back pressure during slewing acceleration and steady operation, in addition to the regeneration effect described above.

More specifically, the communication switching device preferably includes: a first communication valve which is provided between the first pipe-line and the tank and switched between an open position for bringing the first pipe-line into communication with the tank and a closed position for cutting off the first pipe-line from the tank; and a second communication valve which is provided between the second pipe-line and the tank and switched between an open position for bringing the second pipe-line into communication with the tank and a closed position for cutting off the second pipe-line from the tank. In this case, it is preferable that, when the electric system is in a normal state and a slewing is being performed, the controller sets the communication valve that is connected to the outlet-side pipe-line of the first and second communication valves to the open position and sets the other communication valve to the closed position.

Besides, the controller favorably switches the communication switching device to a communication-cutoff state when the slewing is stopped. This makes it possible to exert a hydraulic brake by the brake valve against the hydraulic motor and the upper slewing body to retain them in a stopped state, thus contributing to saved power compared to a case where position retention control of the electric motor is performed in a slewing stopped state.

The invention claimed is:

1. A slewing-type working machine comprising:

a base carrier;

an upper slewing body mounted on the base carrier so as to be capable of being slewed;

a hydraulic motor including first and second ports to receive supply of hydraulic fluid through one of the ports and discharging the hydraulic fluid through the other one of the first and second ports, thereby being operated so as to drive the upper slewing body to slew the upper slewing body;

a hydraulic pump which discharges the hydraulic fluid to be supplied to the hydraulic motor;

an electric motor rotationally driven by the hydraulic motor to perform a regenerative action;

an electric storage device which stores regenerative power of the electric motor;

a slewing operation device which includes an operation member to which an operation is applied to input a command for driving to slew and outputs an operation signal corresponding to the operation applied to the operation member;

a control valve which is operated so as to control supply of hydraulic fluid to the hydraulic motor and discharge of hydraulic fluid from the hydraulic motor, based on the operation signal of the slewing operation device;

a first pipe-line connecting the first port of the hydraulic motor to the control valve;

a second pipe-line connecting the second port of the hydraulic motor to the control valve;

a brake valve connected to the first and second pipe-lines to perform a hydraulic braking action against the hydraulic motor when the operation in a direction for deceleration is applied to the operation member;

a communication switching device capable of being switched between a communication state of bringing a pipe-line on an outlet side of the hydraulic motor of both of the pipe-lines into communication with a tank or a pipe-line on an inlet side of the hydraulic motor of both of the pipe-lines and a communication-cutoff state of cutting off the communication;

an operation detector which detects the operation applied to the operation member of the slewing operation device; and a controller which controls switching of the communication switching device based on a detection signal from the operation detector, wherein: the controller is adapted to judge whether or not there has been occurrence of an abnormal situation where a regenerative action by the electric motor and the electric storage device are impossible or inappropriate, based on signals from an electric system including the electric motor, the electric storage device, and respective control systems of the electric motor and the electric storage device; at least in the case where the deceleration operation is being performed, when the controller judges that the abnormal situation has not occurred, the controller switches the communication switching device to the communication state and outputs a drive command for causing the electric motor to perform a regenerative action; and, in the case of judging that the electric system is in the abnormal situation, the controller switches the communication switching device to the communication-cutoff state and outputs a non-drive command for prohibiting the electric motor from performing a regenerative action.

2. The slewing-type working machine according to claim 1, wherein: the communication switching device is provided between the first and second pipe-lines and the tank and switchable among a state of cutting of both of the pipe-lines from the tank, a state of bringing the first pipe-line into communication with the tank and cutting off the second pipe-line from the tank, and a state of bringing the second pipe-line into communication with the tank and cutting off the first pipe-line from the tank; and the controller operates the communication switching device, when the electric system is in a normal state and a slewing operation is being performed, so as to bring a pipe-line corresponding to an outlet-side pipe-line, which is one pipe-line on an outlet side of the hydraulic motor of the first and second pipe-lines, into communicated with a tank and so as to cut off the other one of the first and second pipe-lines from the tank.

3. The slewing-type working machine according to claim 2, wherein the communication switching device includes: a first communication valve which is provided between the first pipe-line and the tank and switched between an open position for bringing the first pipe-line into communication with the tank and a closed position for cutting off the first pipe-line from the tank; and a second communication valve which is provided between the second pipe-line and the tank and switched between an open position for bringing the second pipe-line into communication with the tank and a closed position for cutting off the second pipe-line from the tank, and wherein, when the electric system is in a normal state and a slewing is being performed, the controller sets the communication valve that is connected to the outlet-side pipe-line of the first and second communication valves to the open position and sets the other communication valve of the first and second communication valves to the closed position.

4. The slewing-type working machine according to claim 1, wherein the controller switches the communication switching device to a communication-cutoff state when the slewing is stopped.

* * * * *